US005540174A

United States Patent [19]

Kishi et al.

[11] Patent Number: 5,540,174

[45] Date of Patent: Jul. 30, 1996

[54] TRIM ADJUSTING SYSTEM FOR JET PROPULSION BOAT

[75] Inventors: Hideki Kishi; Hirofumi Imaeda, both of Iwata, Japan

[73] Assignee: Yamaha Hatsudoki Kabushiki Kaisha, Iwata, Japan

[21] Appl. No.: 322,602

[22] Filed: Oct. 13, 1994

[30] Foreign Application Priority Data

Oct. 13, 1993 [JP] Japan ..... 5-255896

[51] Int. Cl.[6] ..... B63H 11/113

[52] U.S. Cl. ..... 114/291; 440/38; 440/42

[58] Field of Search ..... 440/40, 42, 38; 114/270, 271, 291

[56] References Cited

U.S. PATENT DOCUMENTS

| | | | |
|---|---|---|---|
| 3,623,447 | 11/1971 | Jacobson | 114/270 |
| 3,788,265 | 1/1974 | Moore | 440/42 |
| 3,911,846 | 10/1975 | England | 440/38 |
| 4,619,215 | 10/1986 | Wood et al. | 114/291 |
| 4,903,626 | 2/1990 | Haines | 114/291 |
| 4,932,347 | 6/1990 | Mardikian | 114/270 |
| 5,131,346 | 7/1992 | Ohta et al. | 114/270 |

*Primary Examiner*—Sherman Basinger
*Attorney, Agent, or Firm*—Knobbe, Martens, Olson & Bear

[57] ABSTRACT

A small jet propelled watercraft having a hull undersurface provided with a plurality of stripes and a step at the rear end thereof to reduce porpoising without increasing drag. The watercraft is propelled by a jet propulsion unit having a discharge nozzle which is capable of trim adjustment and which is controlled by a twist grip control mounted on its steering handlebar.

16 Claims, 8 Drawing Sheets

TRIM ADJUSTING SYSTEM FOR JET PROPULSION BOAT

BACKGROUND OF THE INVENTION

This invention relates to a trim adjusting system for a jet propulsion boat and more particularly to an improved hull configuration for a jet boat, an apparatus for adjusting the trim of a boat and a control for the trim adjustment.

A type of watercraft that has become very popular is known as a "personal watercraft." Such personal watercraft are designed to be operated by a rider and will accommodate a relatively small number of passengers. Quite frequently, these watercraft are propelled by jet propulsion units. This type of watercraft is also very sporting in nature and the occupants generally wear swimming suits when enjoying such watercraft.

By their very nature, these watercraft are quite small. One problem with watercraft of such small size, particularly those having relatively short lengths, is that they evidence a tendency to porpoise. Although the porpoising effect can be reduced by increasing the length of the hull, the increased hull length gives rise to added drag and loss in performance.

It is, therefore, a principle object of this invention to provide an improved hull for a small watercraft wherein the effect of porpoising can be decreased without increasing the drag of the hull.

One way in which the porpoising effect can be eliminated without increasing the drag is to employ a step at the rear of the hull. By employing such step, the effective length of the hull can be increased while the drag is decreased. With these arrangements, however, the effect of the step is generally fixed and this may not always be desirable.

It is, therefore a still further object of this invention to provide an improved stepped watercraft hull having an apparatus for adjusting the trim of the hull and the effectiveness of the step.

One way in which the trim of a watercraft can be adjusted if powered by a jet propulsion unit is by pivoting the discharge nozzle about a horizontally disposed transversely extending axis. Upon such pivoting, the trim of the watercraft can be adjusted. This feature is particularly advantageous when utilized with stepped hulls. However, it is desirable to provide a simple and easy way in which the trim can be adjusted by the operator and which will not necessitate his taking his hands off of the steering control for the watercraft to effect trim adjustment.

It is, therefore, a still further object of this invention to provide an improved trim adjustment mechanism for a watercraft.

SUMMARY OF THE INVENTION

A first feature of the invention is adapted to be embodied in a small personal watercraft comprising a hull having a V-shaped bottom. A step is provided at the rear of the hull so as to reduce the porpoising effect without significantly effecting the drag.

A further feature of the invention is adapted to be embodied in a watercraft having a hull of the type which is described in the preceding paragraph and which further includes a jet propulsion unit having a discharge nozzle. The discharge nozzle is supported for pivotal movement about a transversely extending horizontal axis for adjusting the trim of the watercraft and this nozzle is disposed to the rear of the step.

A further feature of the invention is adapted to be embodied in a control for the discharge nozzle of a watercraft having a construction as described in the preceding paragraph. The discharge nozzle is steerable by means of a handle bar assembly. A twist handle grip is supported on one end of the handle bar assembly and is connected to the discharge nozzle for adjusting its trim angle in response to changes in the rotational position of the handle grip.

DETAILED DESCRIPTION OF THE PREFERRED EMBODIMENT OF THE INVENTION

Figure 1:
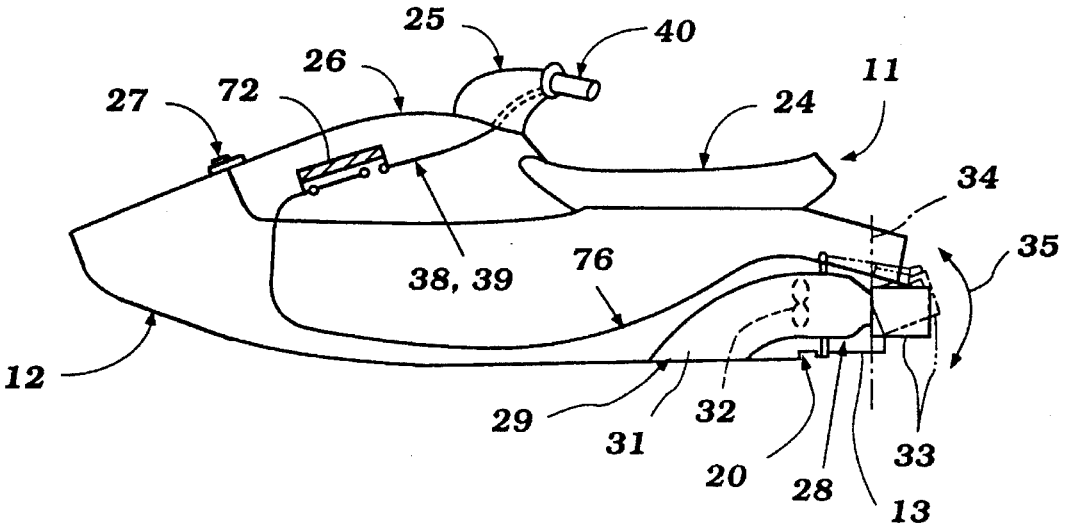
FIG. 1 is a side elevational view of a small watercraft constructed in accordance with an embodiment of the invention, with portions broken away.
Figure 2:
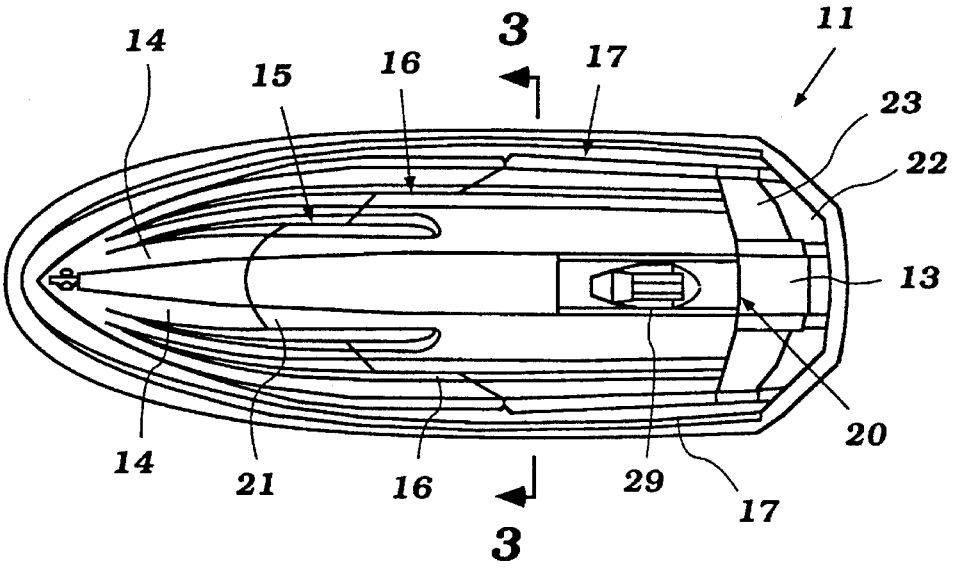
FIG. 2 is a bottom plan view of the watercraft showing the wetted portion of the hull under one running and trim adjusted condition.
Figure 3:
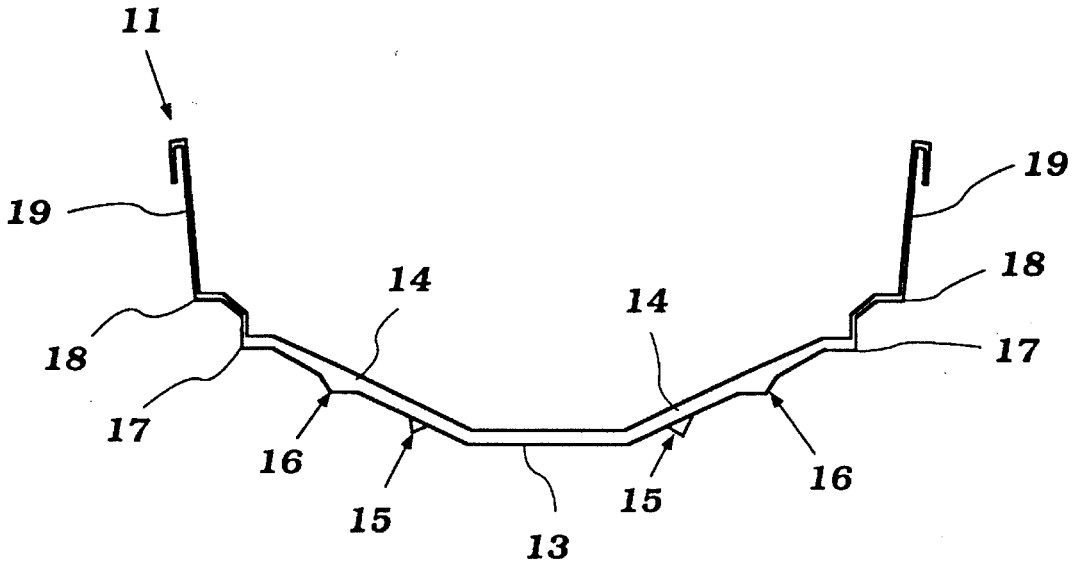
FIG. 3 is an enlarged cross-sectional view taken along the line 3—3 of FIG. 2 and shows the configuration of the hull underside.

Referring now in detail to the drawings and initially to FIGS. 1–3, a small watercraft constructed in accordance with an embodiment of the invention is identified generally by the reference numeral 11. The watercraft 11 is of a type of personal watercraft with which the invention has particular utility. It will be apparent to those skilled in the art, however, that the invention may be employed with other types of watercraft than that illustrated.

The watercraft 11 is comprised of a hull, indicated generally by the reference numeral 12, and which has a V-bottom having a configuration as best seen in FIGS. 2 and 3. This V-bottom includes a generally flat center portion 13 which extends from the area immediately to the rear of the bow in a rearward direction and which increases in width to about the midships and then stays at approximately the same width through the remainder of the length of the hull.

A pair of angularly inclined sections 14 are joined at their inner sides to the flat section and curve inwardly toward the bow. A plurality of stripes or chines are formed beginning at a point rearwardly of the bow and curving outwardly and then going straight toward the rear of the hull 12. The innermost of these strips are indicated by the reference numeral 15 and terminate approximately at the middle of the hull 12 in the longitudinal direction. The next outermost pair of stripes are indicated at 16, and these extend from the front of the hull generally rearwardly and terminate at a step, indicated by the numeral 20, which is disposed toward the transom of the hull 12.

Finally, there are provided an outermost pair of steps or chines 17 which are disposed substantially at the outer periphery of the sides of the hull and which extend all the way to the rear of the hull. Outwardly of these stripes 17 there are provided further edges 18 which are formed at the lower ends of the generally vertically extending sides 19 of the hull.

The shape of the hull as thus far described, including the step 20, will cause the hull to have a forward wetted area, indicated by the reference numeral 21, and a rear wetted area, indicated by the reference numeral 22, when traveling in a straight-ahead direction. The area 23 immediately to the rear of the step 20 will not be wetted. Hence, the wetted area of the hull provides an effective length that extends from the area 21 to the end of the area 22 for the purpose of eliminating or reducing porpoising. However, since the area 23 is not wetted, then the drag on the hull will be reduced.

Continuing on to describe the watercraft 11, it is provided with a longitudinally extending seat 24 to the rear of a handlebar assembly 25. The seat 24 is designed so as to accommodate one or more riders seated in straddle-tandem fashion. The upper portion of the hull 12 is provided with recessed foot areas (not shown in the drawings) in which the feet of the riders are accommodated. The handlebar assembly 25 is provided on a hatch cover 26 that is pivotally connected to the hull 12 at a forward end thereof by a hinge 27. The hatch cover 26 covers an engine compartment in which a powering internal combustion engine of any type is contained.

This engine drives a jet propulsion unit that is disposed beneath the seat 24 and within the hull 12 to the rear of the watercraft. The watercraft hull 12 may be provided with a tunnel in which the jet propulsion unit, indicated generally by the reference numeral 28, is positioned. However, the lower portion of this tunnel is closed by a closure plate so as to provide a smooth hull undersurface.

The jet propulsion unit includes a downwardly facing water inlet opening 29 that opens through the hull undersurface and through which water may be drawn into an inlet duct 31. The inlet duct 31 terminates at an impeller housing portion in which an impeller 32 is positioned and which impeller is driven by the engine in a well-known manner. Water is then discharged through a discharge nozzle 33 which is pivotal about a vertically extending steering axis, indicated by the line 34, being steered for this movement by the handlebar assembly 25 in a well-known manner. In addition, the discharge nozzle 33 is pivotal about a transversely extending horizontal axis, as shown by the arrow 35, so as to adjust the effective trim of the watercraft. By changing the trim adjustment, the amount of the unwetted area 23 to the rear of the step 17 can be adjusted so as to adjust the anti-porpoising effect dependent upon speed and water conditions. This trim adjustment is effected by means of a twist handle grip control, indicated generally by the reference numeral 40, and which has a construction as best shown in FIGS. 4–8.

This twist handle grip control 40 is comprised of a first tubular portion 36 that is journaled for rotation in an appropriate manner on one end of the handlebar assembly 25. This portion 36 is provided with an integral pulley 37 to which ends of a pair of bowden wire actuators 38 and 39 are connected by means of fasteners 41 and 42, respectively. These fasteners 41 and 42 are received in openings 43 and 44 of the pulley 37 of the portion 36. This pulley 37 is formed with a groove 45 in which the cables 38 and 39 are received. These cables are connected to the nozzle 33 in a manner which will be described.

Figure 7:
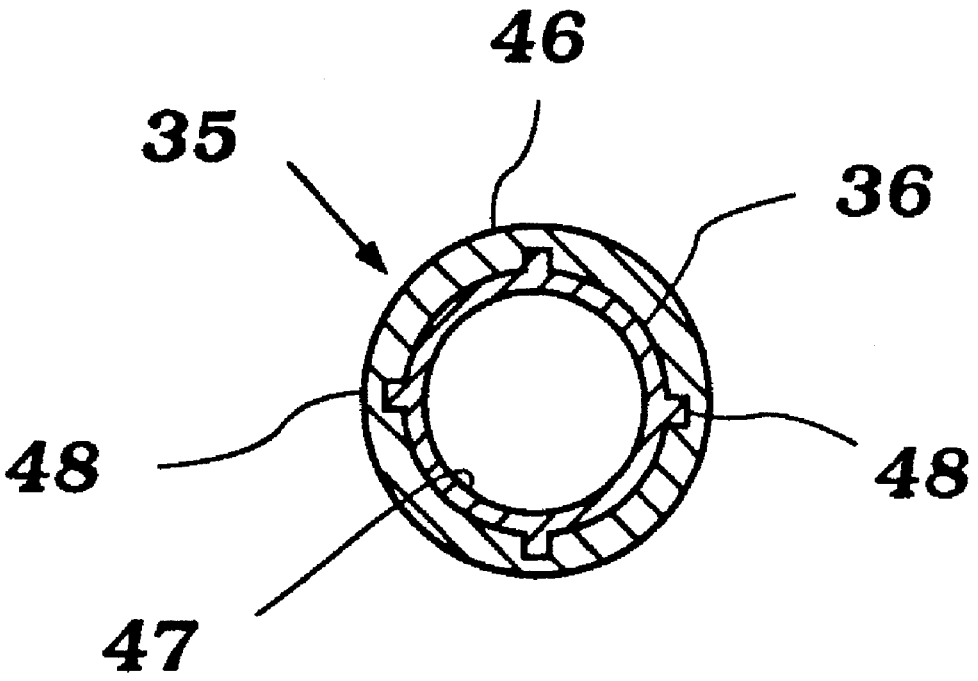
FIG. 7 is a cross-sectional view taken along the line 7—7 of FIG. 6.

A handle grip 46 is formed from a suitable wear-resistant and cushioning material and has an opening 47 that is complementary to the handle 36 and which is slidably received thereon. So as to ensure that the handle grip 46 does not rotate relative to the handle 36, the handle 36 is formed with longitudinally extending ribs 48 that are received in complementary grooves formed in the handle grip 46 (FIG. 7).

Figure 6:
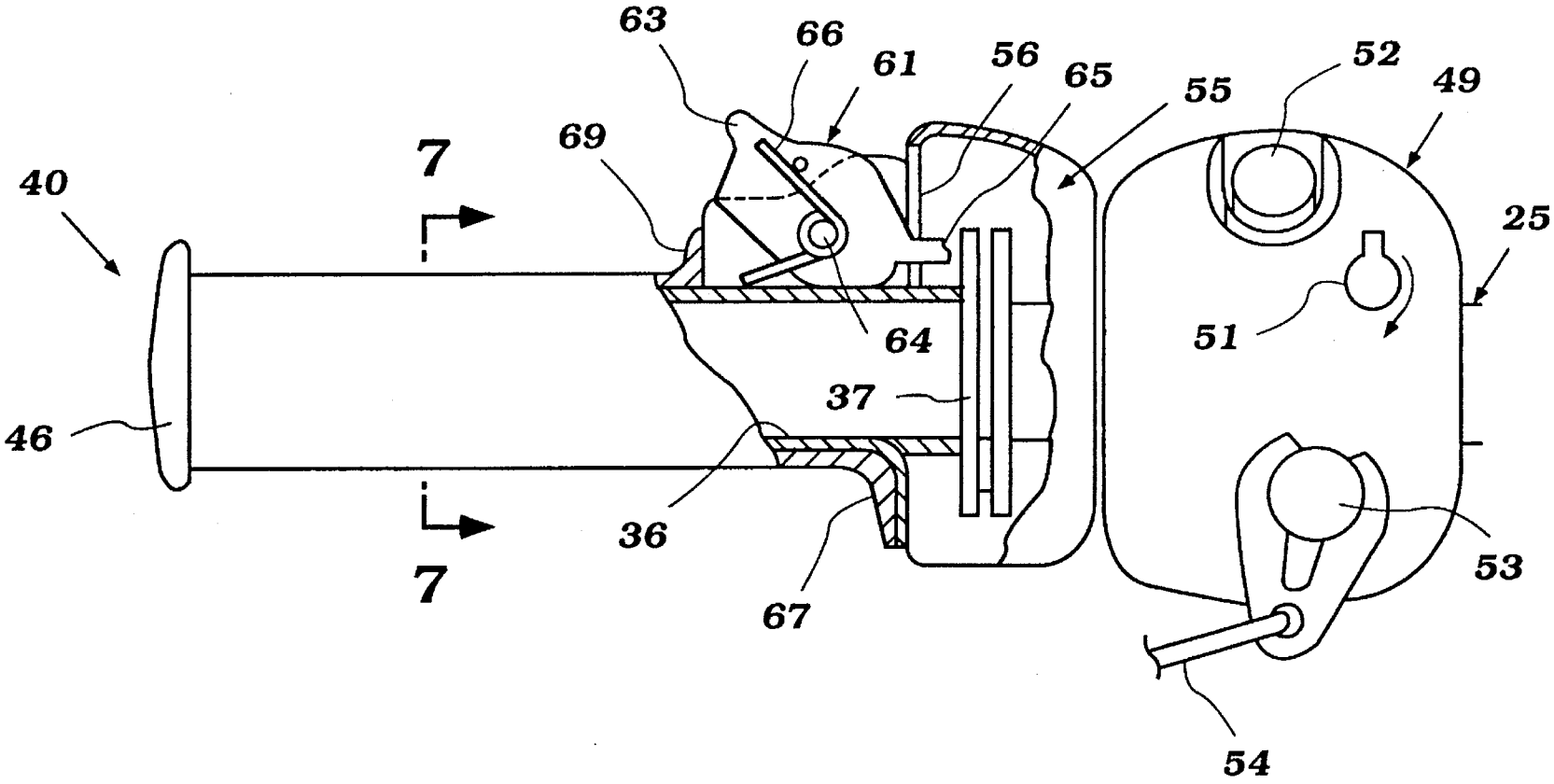
FIG. 6 is a top plan view of the trim adjustment mechanism, with a portion broken away, in a locked condition.
Figure 8:
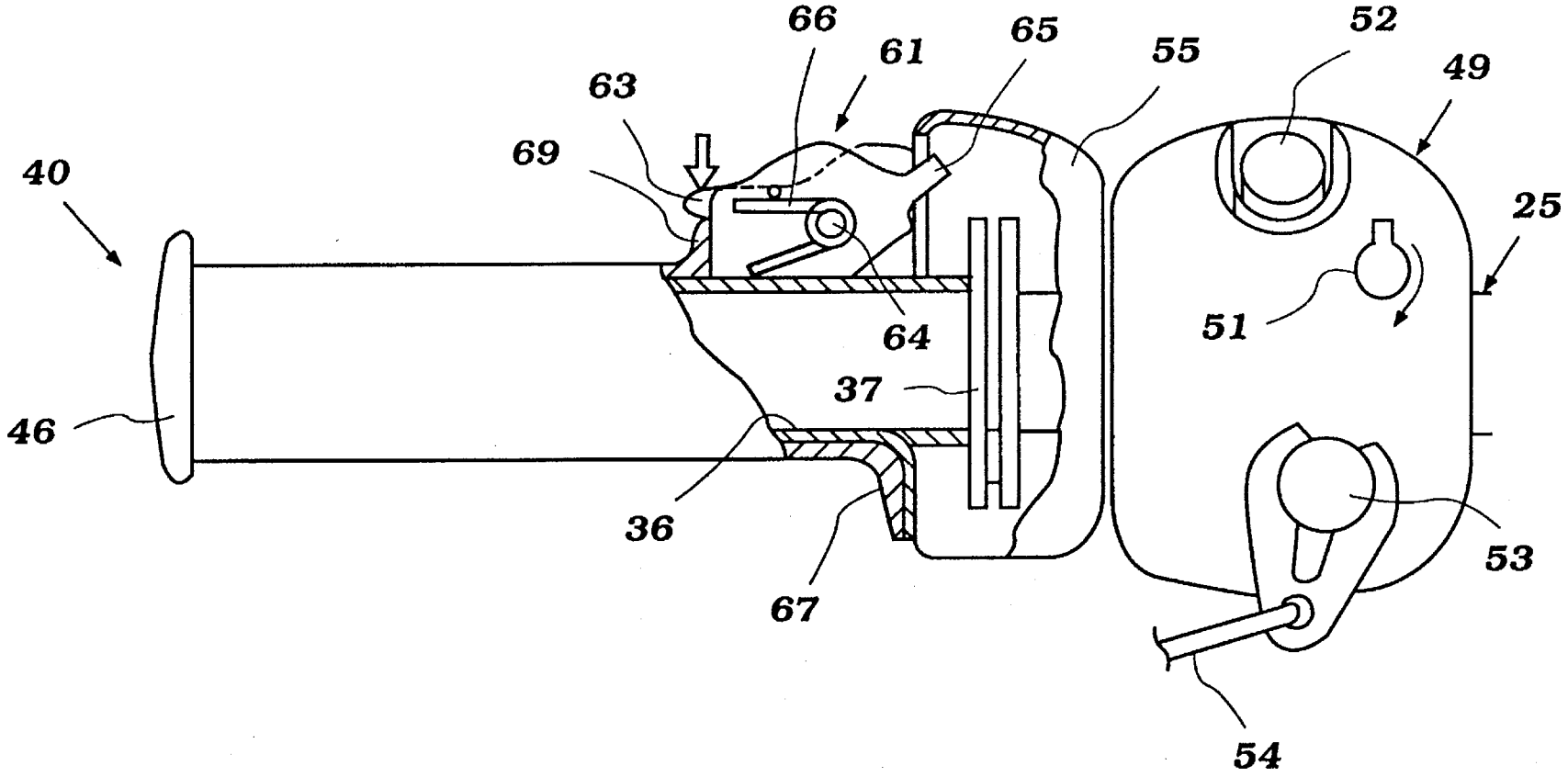
FIG. 8 is a top plan view, with a portion broken away in part similar to FIG. 6, and shows the locking mechanism in its released condition.

It should be noted from FIGS. 6 and 8 that the handlebar assembly 25 adjacent the trim control 40 is provided with a control assembly, indicated generally by the reference numeral 49. This control assembly 49 includes a main switch 51, a starter switch 52, and a safety kill switch 53 that is connected to the operator through a cable 54. As known in this art, if the operator becomes displaced from the watercraft seat 24, the safety switch 53 will be energized so as to stop the engine.

Figure 4:
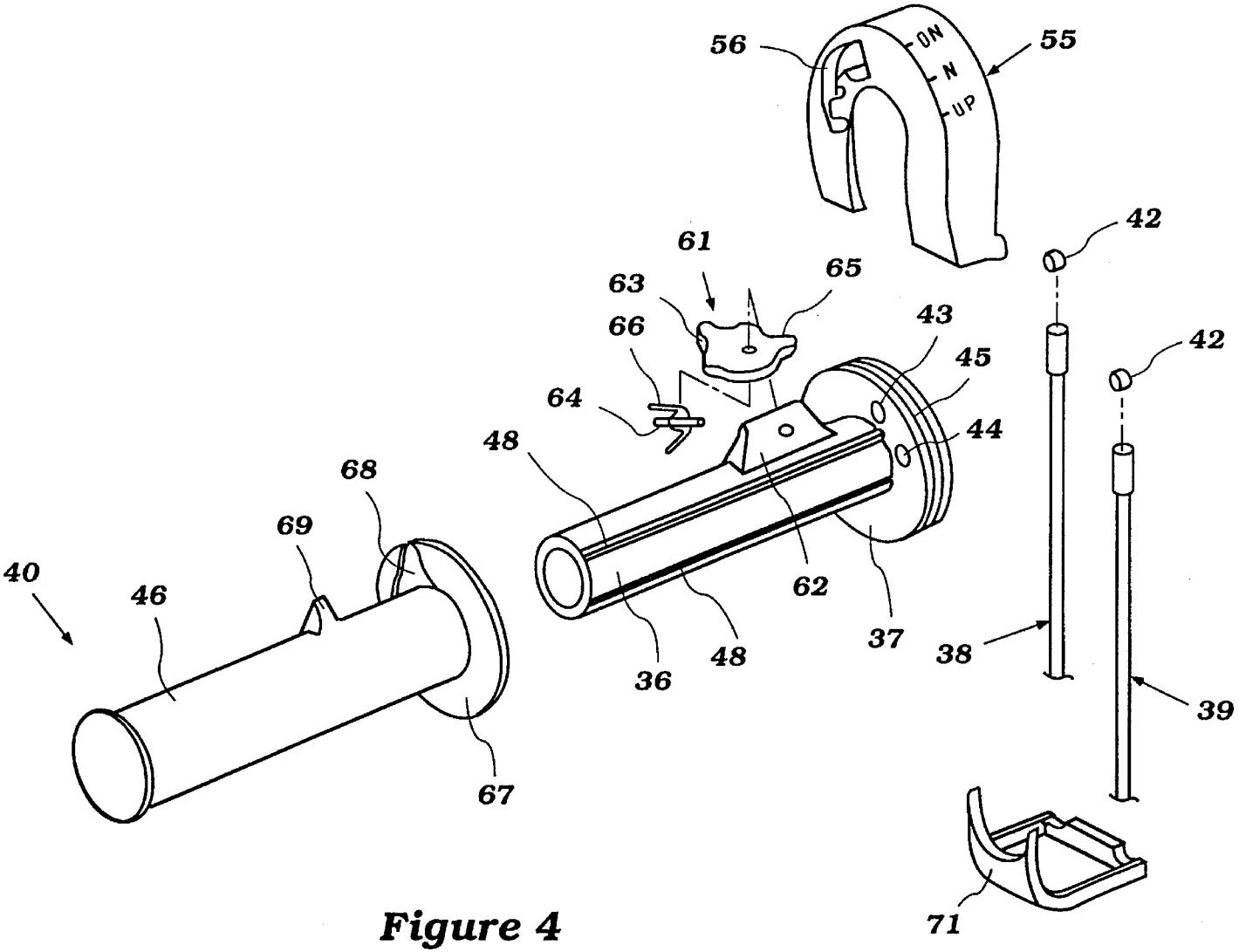
FIG. 4 is an exploded perspective view of the trim control mechanism.
Figure 5:
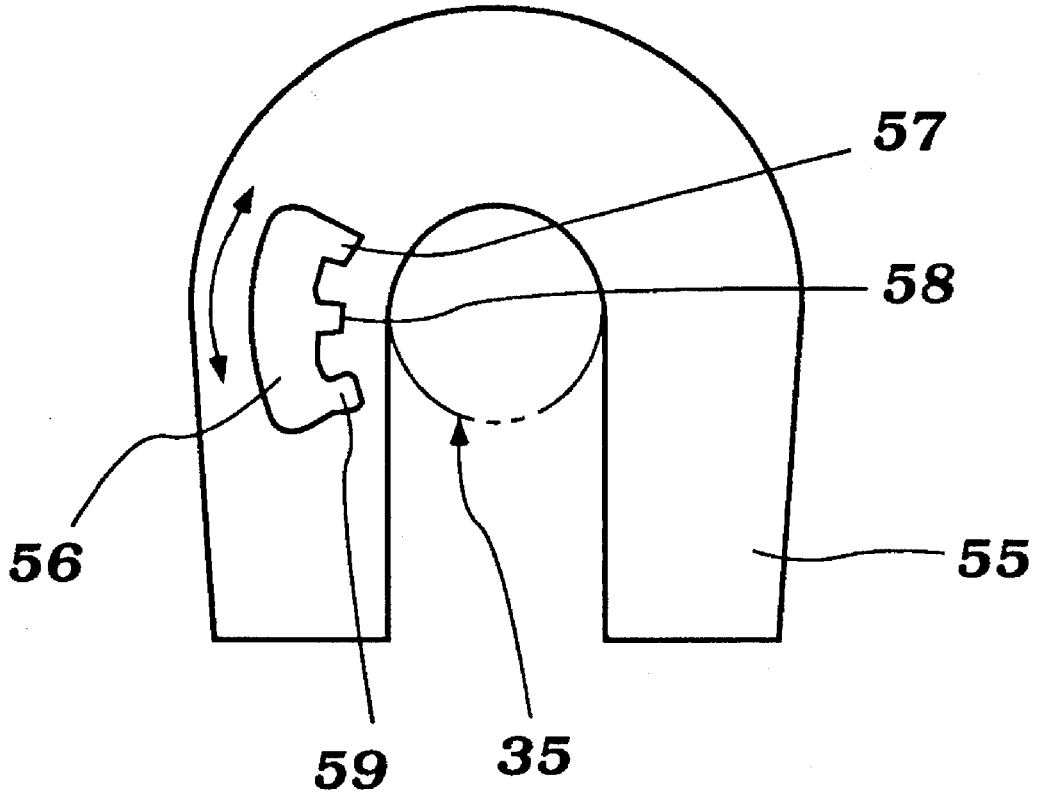
FIG. 5 is a rear elevational view showing a portion of the locking mechanism for the trim adjustment device.

A locking mechanism is provided for locking the trim control 35 in any of a plurality of positions, and this locking mechanism includes a locking collar 55 that is juxtaposed between the control assembly 49 and the trim control 40. This locking collar 55 is provided with a generally arcuate slot 56 that is provided with a plurality of trim-adjusted position notches, indicated at 57, 58, and 59, respectively. The collar 55 may be formed with an appropriate legend, as shown in FIG. 4, so that the operator can readily ascertain which trim-adjusted position the mechanism is locked in.

A locking mechanism that includes the slot 56 and notches 57, 58, and 59 is indicated generally by the reference numeral 61. The handle 36 is provided with an outwardly extending lug 62 on which a locking element 63 is pivotally supported by means of a pivot pin 64. The locking element 63 has a tongue portion 65 which is adapted to extend into the slot 56 and be received in selected ones of the notches 57, 58, and 59 so as to lock the rotational position of the trim control 40. A torsional spring 66 encircles the pin 64 and engages the handle 36 and locking element 63 for urging the locking tongue 65 into one of the notches 57, 58, and 59, as shown in FIG. 6. However, the locking element 63 may be pivoted against the action of the spring 66, as shown in FIG. 8, so that the operator may rotate the handle assembly comprised of the handle 36 and the handle grip 46 to the desired trim-adjusted position. When the locking element 63 is released, it will snap into the newly adjusted position. Although three locked positions are shown in the illustrated embodiment, it will be readily apparent to those skilled in the art that any number of locking positions can be employed.

The handle grip 46 is provided with an annular flange 67, and this flange and the handle grip 46 are provided with an elongated slot 68 that is complementary to the shape of the lug 62 so that the handle grip 46 may be slid onto the handle 36. A stop lug 69 of the handle grip 46 will engage the lug 62 to limit how far the handle grip 46 may be slid into position.

The collar 55 is provided with a lower piece 71 that is affixed thereto and which defines a neat, overall housing assembly around the trim control 35.

Figure 9:
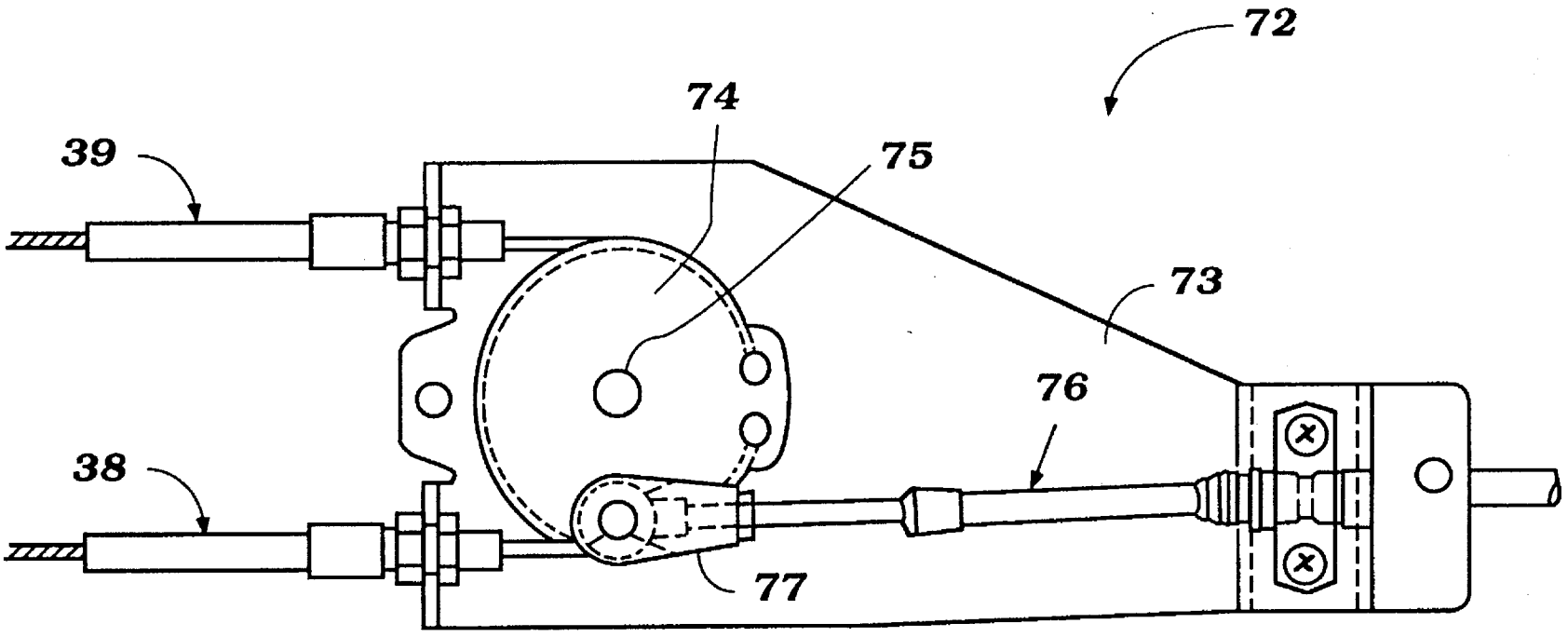
FIG. 9 is a bottom plan view showing the mechanism for transmitting the trim control from the operating assembly shown in FIGS. 4–8 to the discharge nozzle of the jet propulsion unit.

The manner in which the wire actuators 38 and 39 are connected to the nozzle 33 for trim adjustment will now be described by reference to FIGS. 1 and 9. This includes a motion translating mechanism, indicated generally by the reference numeral 72, and which is affixed to the underside of the hatch cover 26 so as to pivot with it. This includes a mounting bracket 73 on which a pulley 74 is journaled by means of a pivot pin 75. The ends of the wire actuators 38 and 39 are connected to the pulley 74 so that when the trim-adjusting handle assembly 35 is rotated, the pulley 74 will also rotate. A further bowden wire cable assembly 76 has one end connected to the pulley 74 by a fastener 77. The other end of the wire actuator 76 is connected suitably to the discharge nozzle 33 so as to move it, as will be readily apparent.

Thus, from the foregoing description, it should be evident that the described hull configuration permits the effective lengthening of the hull without increasing its drag, adjusting the trim of the hull, and provides an improved trim adjustment for a jet propulsion unit. Of course, the foregoing description is that of a preferred embodiment of the invention, and various changes and modifications may be made without departing from the spirit and scope of the invention as defined by the appended claims.

What is claimed is:

1. A watercraft comprised of a hull having a V-shaped bottom with a transversely extending step at the rear thereof for reducing the drag of the hull and for reducing the likelihood of porpoising, and a jet propulsion unit mounted within said hull for propelling said hull, said jet propulsion unit having a water inlet opening formed in the underside of said hull forwardly of said step for drawing water from the body of water in which said watercraft is operating, an impeller fox pumping water through said water inlet opening, and a discharge nozzle disposed to the rear of said step for discharging the pumped water for providing a propulsion force for said watercraft, said step extending transversely outwardly beyond and to the rear of the sides of said water inlet opening.

2. A watercraft as in claim 1, wherein the discharge nozzle of the jet propulsion unit is pivotal about a transversely extending horizontal axis for changing the trim of the watercraft.

3. A watercraft as in claim 2, wherein the hull is provided with a plurality of transversely spaced stripes, with certain of the stripes terminating at the step and other of the stripes extending rearwardly beyond the step.

4. A watercraft as in claim 2, further including a handlebar assembly carrying a twist grip handle for adjusting only the pivotal of the discharge nozzle about the horizontal axis.

5. A watercraft as in claim 4, wherein the handlebar assembly is also connected to the steering nozzle for steering the nozzle about a vertically extending steering axis.

6. A watercraft as in claim 5, wherein the twist grip handle carries a pivoted latching member for latching the handle in any of a plurality of trim-adjusted positions.

7. A watercraft as in claim 6, wherein the handlebar assembly is connected to the discharge nozzle by a bowden wire cable assembly.

8. A watercraft as in claim 1, wherein the hull is provided with a plurality of transversely spaced stripes, with certain of the stripes terminating at the step and other of the stripes extending rearwardly beyond the step.

9. A watercraft as in claim 8, wherein the center of the hull has a generally flat portion in which the water inlet opening is formed.

10. A watercraft as in claim 8, wherein the innermost of the stripes terminates ahead of the step and the other of the stripes terminate at the step.

11. A jet propelled watercraft comprised of a hull, a jet propulsion unit mounted in said hull and having a downwardly facing water inlet opening through which water is drawn, an impeller driven by an engine for drawing water through said inlet opening, and a discharge nozzle through which the water is discharged and which discharge nozzle is pivotal about a transversely extending horizontal trim axis for adjusting the trim of said watercraft, a handlebar assembly for steering the watercraft, and a twist grip trim control rotatably journaled on said handlebar assembly and connected to said discharge nozzle for only adjusting the trim thereof.

12. A jet propelled watercraft as in claim 11, wherein the handlebar assembly is connected to the steering nozzle for steering the nozzle about a vertically extended steering axis.

13. A jet propelled watercraft as in claim 12, wherein the twist grip trim control carries a means for latching the handle in any of a plurality of trim-adjusted positions.

14. A jet propelled watercraft as in claim 13, wherein the twist grip trim control is connected to the discharging nozzle by a bowden wire cable assembly.

15. A jet propelled watercraft as in claim 14, wherein the bowden wire cable assembly comprises a pair of bowden wires connected to the twist grip and operated thereby and operatively connected at their other ends to a pulley, a second bowden wire cable affixed at one end to said pulley and at the other end to the discharge nozzle.

16. A jet propelled watercraft as in claim 13 wherein the means for latching the trim control comprises a pivoted latching member.

* * * * *